United States Patent [19]

Rotolico et al.

[11] Patent Number: 4,865,252

[45] Date of Patent: Sep. 12, 1989

[54] HIGH VELOCITY POWDER THERMAL SPRAY GUN AND METHOD

[75] Inventors: Anthony J. Rotolico, Hauppauge; Lawrence A. Saia, Levittown; Martin E. Hacker, Lake Ronkonkoma; William H. Maidhof, Kings Park, all of N.Y.

[73] Assignee: The Perkin-Elmer Corporation

[21] Appl. No.: 193,030

[22] Filed: May 11, 1988

[51] Int. Cl.[4] ..... B05B 1/24

[52] U.S. Cl. ..... 239/8; 219/121.48; 239/13; 239/85; 239/290; 239/390; 239/414; 239/416.4

[58] Field of Search ..... 239/1, 8, 13, 81, 85, 239/290, 390, 391, 397, 414, 416.1, 416.4, 424; 219/121.47, 121.48, 121.5, 121.51

[56] References Cited

U.S. PATENT DOCUMENTS

| | | | |
|---|---|---|---|
| 2,317,173 | 4/1943 | Bleakley | 91/12.2 |
| 2,361,420 | 10/1944 | Shepard | 91/12.2 |
| 2,714,563 | 8/1955 | Pooaman et al. | 117/105 |
| 2,794,677 | 6/1957 | Collardin et al. | 239/85 |
| 2,960,275 | 11/1960 | Wolf | 239/85 |
| 3,148,818 | 9/1964 | Charlop | 226/176 |
| 3,171,599 | 3/1965 | Rotolico | 239/85 |
| 3,455,510 | 7/1969 | Rotolico | 239/85 |
| 3,501,097 | 3/1970 | Daley | 239/85 |
| 3,514,036 | 5/1970 | Smith, Sr. et al. | 239/85 |
| 3,530,892 | 9/1970 | Charlop et al. | 137/625.19 |
| 3,779,462 | 12/1973 | Bruninga | 239/390 |
| 4,416,421 | 11/1983 | Browning | 239/79 |
| 4,632,309 | 12/1986 | Reimer | 239/85 |
| 4,688,722 | 8/1987 | Dellassio et al. | 239/390 |

FOREIGN PATENT DOCUMENTS

| | | | |
|---|---|---|---|
| 1041056 | 10/1953 | France . | |
| 1325474 | 3/1963 | France | 239/290 |
| 1437713 | 3/1966 | France . | |

*Primary Examiner*—Andres Kashnikow
*Assistant Examiner*—Michael J. Forman
*Attorney, Agent, or Firm*—H. S. Ingham; E. T. Grimes

[57] ABSTRACT

A method of and apparatus for producing a dense and tenacious coating with a thermal spray gun including a nozzle member and a gas cap. The gas cap extends from the nozzle and has an inwardly facing cylindrical wall defining a combustion chamber with an open end and an opposite end bounded by the nozzle. An annular flow of a combustible mixture is injected at a pressure of at least two bar above atmospheric pressure from the nozzle coaxially into the combustion chamber. An annular outer flow of pressurized air is injected from the nozzle adjacent to the cylindrical wall. Heat fusible powder entrained in a carrier gas is fed axially from the nozzle into the combustion chamber. An annular inner flow of pressurized air is injected from the nozzle into the combustion chamber coaxially between the combustible mixture and the powder-carrier gas. Upon combusting the annular mixture a supersonic spray stream containing the powder is propelled through the open end to produce a coating. A second gas cap with a different size open end may be selected to effect a different size spray stream.

22 Claims, 4 Drawing Sheets

HIGH VELOCITY POWDER THERMAL SPRAY GUN AND METHOD

This invention relates to thermal spraying and particularly to a method and a gun for combustion thermal spraying powder at very high velocity.

BACKGROUND OF THE INVENTION

Thermal spraying, also known as flame spraying, involves the heat softening of a heat fusible material such as metal or ceramic, and propelling the softened material in particulate form against a surface which is to be coated. The heated particles strike the surface where they are quenched and bonded thereto. A thermal spray gun is used for the purpose of both heating and propelling the particles. In one type of thermal spray gun, the heat fusible material is supplied to the gun in powder form. Such powders are typically comprised of small particles, e.g., between 100 mesh U. S. Standard screen size (149 microns) and about 2 microns. The carrier gas, which entrains and transports the powder, can be one of the combustion gases or an inert gas such as nitrogen, or it can be simply compressed air.

The material alternatively may be fed into a heating zone in the form of a rod or wire such as described in U.S. Pat. No. 3,148,818 (Charlop). In the wire type thermal spray gun, the rod or wire of the material to be sprayed is fed into the heating zone formed by a flame of some type, such as a combustion flame, where it is melted or at least heat-softened and atomized, usually by blast gas, and thence propelled in finely divided form onto the surface to be coated. Especially high quality coatings of thermal spray materials may be produced by spraying at very high velocity. Plasma spraying has proven successful with high velocity in many respects but in certain cases, especially with carbides, it is not as good as combustion, apparently due to overheating and/or to poor particle entrainment which must be effected by feeding powder laterally into the high velocity plasma stream.

U.S. Pat. No. 2,714,563 (Poorman et al) discloses a detonation gun for blasting powdered material in a series of detonations to produce coatings such as carbides. Since the detonation pulses are very harmful to the ears the apparatus must be operated by remote control in an isolated room, and also the process is quite complex. Therefore this method has been expensive and commercially limited in availability. Also it has not lent itself to full control of spray pattern and efficient target efficiency. However, the detonation process has demonstrated the desirability of spraying at very high velocity. High density and tenacity of coatings are achieved by high impact of the powder particles, and the short dwell time in the heating zone minimizes oxidation at the high spray temperatures.

A rocket type of powder spray gun can produce excellent coatings and is typified in U.S. Pat. No. 4,416,421 (Browning). This type of gun has an internal combustion chamber with a high pressure combustion effluent directed through an annular opening into the constricted throat of a long nozzle chamber. Powder is fed axially within the annular opening into the nozzle chamber to be heated and propelled by the combustion effluent. In practice the gun must be water cooled and a long nozzle is particularly susceptible to powder buildup. Also, ignition in an internal chamber requires special technique; for example a hydrogen pilot flame is used. There are safety concerns with an enclosed high pressure combustion chamber. A long nozzle is not geometrically suitable for spraying on inside diameters or other such remote areas, and is somewhat restricted with respect to varying and selecting the size of the spray stream. Best results have been effected commercially in such a rocket gun with hydrogen for the combustion gas which must be used at high flow rates, causing the process to be quite expensive.

Short-nozzle spray devices are disclosed for high velocity spraying in French Patent Nos. 1,041,056 and U.S. Pat. No. 2,317,173 (Bleakley). Powder is fed axially into a melting chamber within an annular flow of combustion gas. An annular air flow is injected coaxially outside of the combustion gas flow, along the wall of the chamber. The spray stream with the heated powder issues from the open end of the combustion chamber. There are not sufficient details taught in the Bleakley and French patents for one to attain truly high velocity powder spraying, and apparently no significant commercial use has been made of these devices, despite the references being 45 and 35 years old respectively.

The Bleakley and French short-nozzle devices superficially have a nozzle construction similar to commercial wire spray guns of the type disclosed in the aforementioned U.S. Pat. No. 3,148,818. However, wire guns function quite differently, with the combustion flame melting the wire tip and the air atomizing the molten material from the tip and propelling the droplets. Wire guns generally have been used to spray only at moderate velocity.

SUMMARY OF THE INVENTION

Therefore, objects of the present invention are to provide an improved method and apparatus for combustion powder thermal spraying at high velocity, to provide a method and apparatus for producing dense tenacious thermal sprayed coatings at reasonable cost, to provide a method and apparatus for thermal spraying at high velocity with reduced tendency for nozzle buildup, to provide a method and apparatus for thermal spraying at high velocity without special lighting equipment or procedures, to provide a method and apparatus for thermal spraying at high velocity without the need for water cooling the gun, to provide a method and apparatus for thermal spraying at high velocity into remote areas, and to provide a high velocity thermal spray apparatus and method with a selection of the size of the spray stream and deposit pattern.

The foregoing and other objects of the present invention are achieved by a novel thermal spray gun for spraying at high velocity to produce a dense and tenacious coating. The gun comprises a nozzle member with a nozzle face, and a gas cap extending from the nozzle member and having an inwardly facing cylindrical wall defining a cylindrical combustion chamber with an open end and an opposite end bounded by the nozzle face. The gun further comprises combustible gas means for injecting an annular flow of a combustible mixture of a combustion gas and oxygen from the nozzle coaxially into the combustion chamber at a pressure therein of at least two bar above atmospheric pressure, outer gas means for injecting an annular outer flow of pressurized non-combustible gas adjacent to the cylindrical wall radially outward of the annular flow of the combustible mixture, feeding means for feeding heat fusible thermal spray powder in a carrier gas axially from the nozzle into the combustion chamber, and inner gas means for injecting an annular inner flow of pressurized gas from the nozzle member into the combustion chamber coaxially between the combustible mixture and the powder-carrier gas. With a combusting combustible mixture, a supersonic spray stream containing the heat fusible material in finely divided form is propelled through the open end.

In a preferable embodiment the nozzle member comprises a tubular outer portion defining an outer annular orifice means for injecting the annular flow of the combustion mixture into the combustion chamber. A tubular inner portion has therein an annular inner gas orifice means for injecting the annular inner flow into the combustion chamber, and an inner powder orifice means for feeding the powder carrier gas into the combustion chamber. Preferably the inner portion protrudes into the combustion chamber forwardly of the outer portion.

In a further embodiment the thermal spray gun further comprises selection means for selecting the diameter of the open end such as to effect a selected size of the spray stream. Preferably the selection means comprises a first gas cap disposed on the gas head to form the combustion chamber with a first open end, and a second gas cap adapted to be interchanged with the first gas cap on the gas head to form a replacement combustion chamber defined by a second cylindrical wall with a second open end different in diameter than the first open end. The second gas cap is interchangeable with the first gas cap for selection between the first open end and the second open end.

The objectives are also achieved by a method for producing a dense and tenacious coating with a thermal spray gun including a nozzle member with a nozzle face and a gas cap extending from the nozzle member. The gas cap has an inwardly facing cylindrical wall defining a cylindrical combustion chamber with an open end and an opposite end bounded by the nozzle face. The method comprises injecting an annular flow of a combustible mixture of a combustion gas and oxygen from the nozzle coaxially into the combustion chamber at a pressure therein of at least two bar above atmospheric pressure, injecting an annular outer flow of pressurized non-combustible gas adjacent to the cylindrical wall radially outward of the annular flow of the combustible mixture, feeding heat fusible thermal spray powder in a carrier gas axially from the nozzle into the combustion chamber, injecting an annular inner flow of pressurized gas from the nozzle member into the combustion chamber coaxially between the combustible mixture and the powder-carrier gas, combusting the combustible mixture whereby a supersonic spray stream containing the heat fusible material in finely divided form is propelled through the open end, and directing the spray stream toward a substrate such as to produce a coating thereon.

Preferably, according to the method the combustible mixture is injected at a sufficient pressure into the combustion chamber to produce at least 8 visible shock diamonds in the spry stream without powder-carrier gas feeding. As a further embodiment, the method further comprises selecting the diameter of the open end such as to effect a selected size of the spray stream.

DETAILED DESCRIPTION OF THE INVENTION

Figure 1:
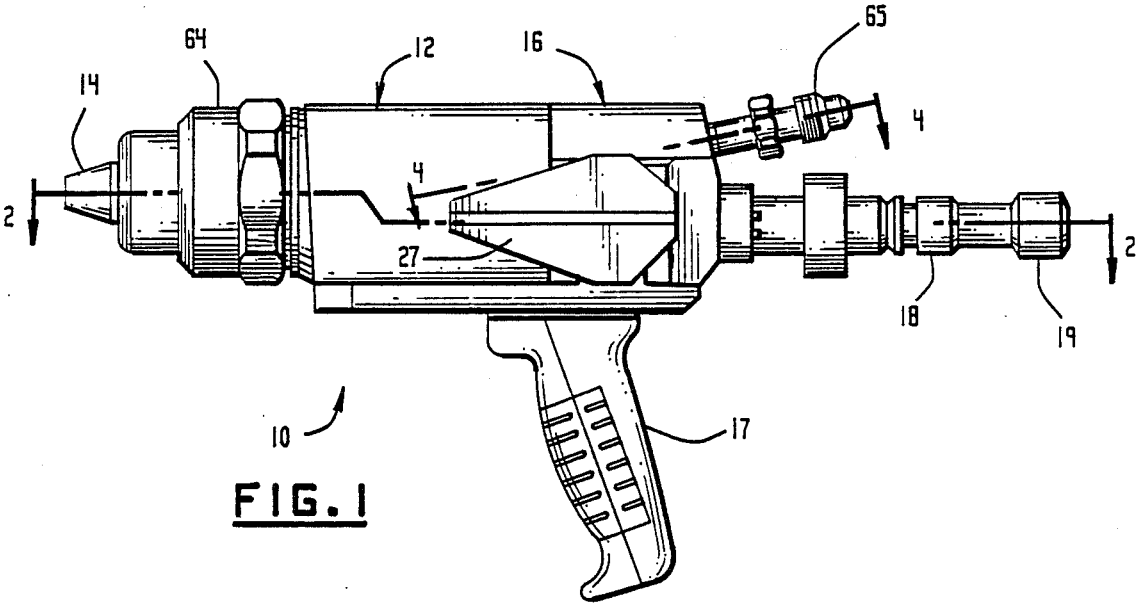
FIG. 1 is an elevation of a thermal spray gun used in the present invention.
Figure 2:
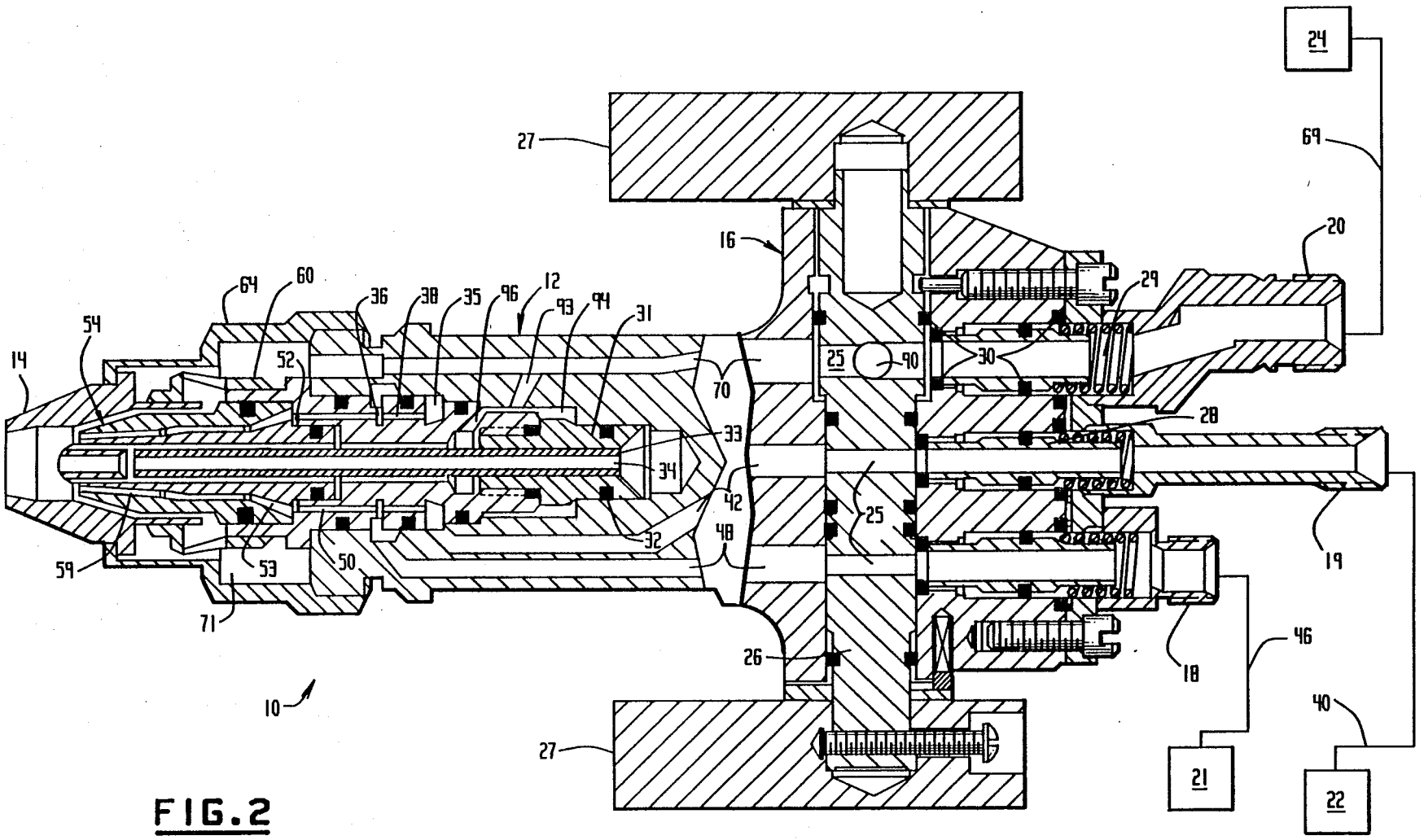
FIG. 2 is a section taken at 2—2 of FIG. 1.

A thermal spray apparatus according to the present invention is illustrated in FIG. 1, and FIG. 2 shows a horizontal section thereof. A thermal spray gun 10 has a gas head 12 with a gas cap 14 mounted thereon, a valve portion 16 for supplying fuel, oxygen and air to the gas head, and a handle 17. The valve portion 16 has a hose connection 18 for a fuel gas, a hose connection 19 for oxygen and a hose connection 20 for air. The three connections are connected respectively by hoses from a fuel source 21, oxygen source 22 and air source 24. Orifices 25 in a cylindrical valve 26 control the flow of the respective gases from their connections into the gun. The valve and associated components are, for example, of the type taught in U.S. Pat. No. 3,530,892, and include a pair of valve levers 27, and sealing means for each gas flow section that include plungers 28, springs 29 and O-rings 30.

A cylindrical siphon plug 31 is fitted in a corresponding bore in gas head 12, and a plurality of O-rings 32 thereon maintain a gas-tight seal. The siphon plug is provided with a tube 33 having a central passage 34. The siphon plug further has therein an annular groove 35 and a further annular groove 36 with a plurality of inter-connecting passages 38 (two shown). With cylinder valve 26 in the open position as shown in FIG. 2, oxygen is passed by means of a hose 40 through its connection 19 and valve 26 into a passage 42 from whence it flows into groove 35 and through passage 38. A similar arrangement is provided to pass fuel gas from source 21 and a hose 46 through connection 18, valve 26 and a passage 48 into groove 36, mix with the oxygen, and pass as a combustible mixture through passages 50 aligned with passages 38 into an annular groove 52. Annular groove 52 feeds the mixture into a plurality of passages 53 in the rear section of a nozzle member 54.

Figure 3:
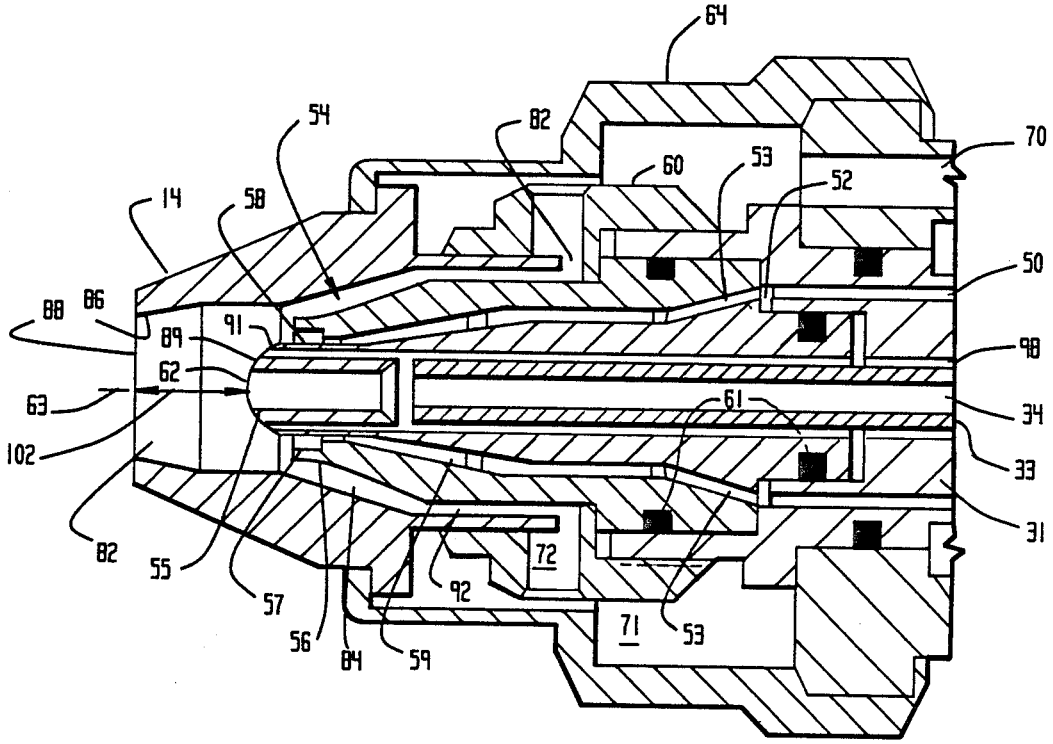
FIG. 3 is an enlargement of the forward end of the section of FIG. 2.

Referring to FIG. 3 for details, nozzle member 54 is conveniently constructed of a tubular inner portion 55 and a tubular outer portion 56. (As used herein and in the claims, "inner" denotes toward the axis and "outer" denotes away from the axis. Also "forward" or "forwardly" denotes toward the open end of the gun; "rear", "rearward" or "rearwardly" denotes the opposite.) Outer portion 56 defines an outer annular orifice means for injecting the annular flow of the combustible mixture into the combustion chamber. The orifice means preferably includes a forward annular opening 57 with a radially inward side bounded by an outer wall 58 of the inner portion. The orifice system leading to the annular opening from passages 53 may be a plurality of accurately spaced orifices, but preferably is an annular orifice 59.

The combustible mixture flowing from the aligned grooves 52 thus passes through the orifice (or orifices) 59 to produce an annular flow which is ignited in annular opening 57. A nozzle nut 60 holds nozzle 54 and siphon plug 28 on gas head 12. Two further O-rings 61 are seated conventionally between nozzle 54 and siphon plug 31 for gas tight seals. The burner nozzle 54 extends into gas cap 14 which is held in place by means of a retainer ring 64 and extends forwardly from the nozzle.

Figure 4:
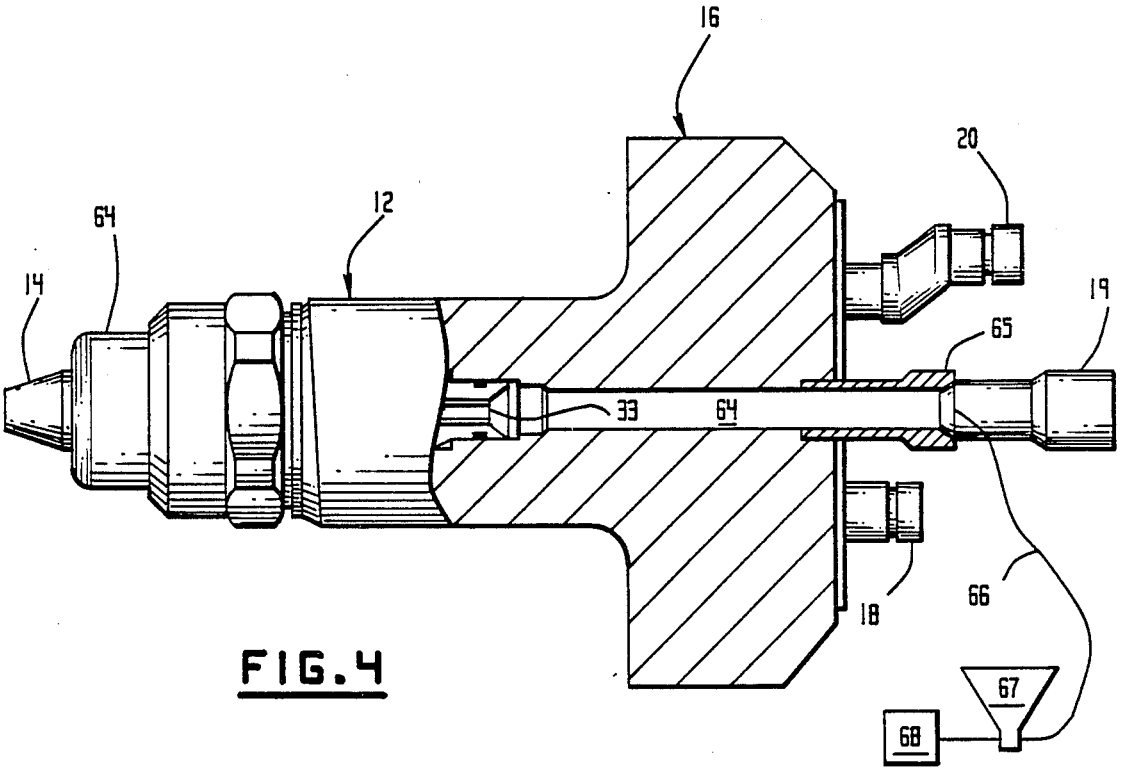
FIG. 4 is a section taken at 4—4 of FIG. 1, and a schematic of an associated powder feeding system.

Nozzle member 54 is also provided with an axial bore 62, for the powder in a carrier gas, extending forwardly from tube passage 33. Alternatively the powder may be injected through a small-diameter ring of orifices (not shown) proximate the axis 63 of the gun. With reference to FIG. 4 a diagonal passage 64 extends rearwardly from tube 33 to a powder connection 65. A carrier hose 66 and, therefore, central bore 62, is receptive of powder from a powder feeder 67 entrained in a carrier gas from a pressurized gas source 68 such as compressed air by way of feed hose 66. Powder feeder 67 is of the conventional or desired type but must be capable of delivering the carrier gas at high enough pressure to provide powder into the chamber 82 in gun 10.

With reference back to FIGS. 2 and 3, air or other non-combustible gas is passed from source 24 and a hose 69 through its connection 20, cylinder valve 26, and a passage 70 to a space 71 in the interior of retainer ring 64. Lateral openings 72 in nozzle nut 60 communicate space 71 with a cylindrical combustion chamber 82 in gas cap 14 so that the air may flow as an outer sheath from space 71 through these lateral openings 72, thence through an annular slot 84 between the outer surface of nozzle 54, and an inwardly facing cylindrical wall 86 defining combustion chamber 82 into which slot 84 exits. The flow continues through chamber 82 as an annular outer flow mixing with the inner flows, and out of the open end 88 in gas cap 14. Chamber 82 is bounded at its opposite, rearward end by face 89 of nozzle 54.

Preferably combustion chamber 82 converges forwardly from the nozzle at an angle with the axis, most preferably between about 2° and 10°, e.g. 5°. Slot 84 also converges forwardly at an angle with the axis, most preferably between about 12° and 16°, e.g. 14.5°. Slot 84 further should have sufficient length for the annular air flow to develop, e.g. comparable to chamber length 102, but at least greater than half of such length 102. In addition, the chamber should converge at a lesser angle than the slot, most preferably between about 8° and 12°, e.g. 10° less. This configuration provides a converging air flow with respect to the chamber to minimize powder buildup on the chamber wall.

The air flow rate should be controlled upstream of slot 84 such as in a rearward narrow orifice 92 or with a separate flow regulator. For example slot length is 8 mm, slot width is 0.38 mm on a 15 cm circle, and air pressure to the gun (connector 20) is 70 psi to produce a total air flow of 900 scfh with a pressure of 60 psi in chamber 82. Also, with valve 26 in a lighting position aligning bleeder holes as described in aforementioned U.S. Pat. No. 3,530,892, an air hole 90 in valve 26 allows air flow for lighting, and the above-indicated angles and dimensions are important to allow such lighting without backfire. (Bleeder holes in valve 26 for oxygen and fuel for lighting, similar to air hole 90, are not shown.)

The inner portion 55 of nozzle member 54 has therein a plurality of parallel inner orifices 91 (e.g. 8 orifices 0.89 mm diameter) on a bolt circle (e.g. 2.57 mm diameter) which provide for an annular inner sheath flow of gas, preferably air, about the central powder feed issuing from bore 62 of the nozzle. This inner sheath of air contributes significantly to reducing any tendency of buildup of powder material on wall 86. The sheath air is conveniently tapped from passage 70, via a duct 93 (FIG. 2) to an annular groove 94 around the rear portion of siphon plug 31 and at least one orifice 96 into an annular space 98 adjacent tube 33. Preferably at least three such orifices 96 are equally spaced arcuately to provide sufficient air and to minimize vortex flow which could detrimentally swirl the powder outwardly to wall 86 of chamber 82. The inner sheath air flow should be between 1% and 10%, preferably about 2% and 5% of the outer sheath flow rate, for example about 3%. The inner sheath may alternatively be regulated independently of the outer sheath air, for better control.

According to a further embodiment, it was discovered that chances of powder buildup are even further minimized by having the inner portion 55 of the nozzle member protrude into chamber 82 forwardly of the outer portion 56 as depicted in FIGS. 2 and 3. A chamber length 102 may be defined as the shortest distance from nozzle face 89 to open end 88, i.e. from the forwardmost point on the nozzle to the open end. Preferably the forwardmost point on the inner portion protrudes forwardly from the outer portion 56 by a distance between about 10% and 40% of chamber length 102, e.g. 30%.

A preferred configuration for the inner portion is depicted in FIGS. 2 and 3. Referring to the outer wall 58 of inner portion 55 of the nozzle, which defines annular opening 57, such wall 58 should extend forwardly from the annular opening with a curvature inward toward the axis. Preferably the curvature is uniform. For example, as shown, the curvature is such as to define a generally hemispherical face 89 on inner portion 58. It is believed that the combustion flame is thereby drawn inwardly to maintain the flows away from chamber wall 86.

As an example of further details of a thermal spray gun incorporating the present invention, siphon plug 31 has 8 oxygen passages 38 of 1.51 mm each to allow sufficient oxygen flow, and 1.51 mm diameter passages 50 for the gas mixture. In this gas head central bore 62 is 3.6 mm diameter, and the open end 88 of the gas cap is 0.95 cm from the face of the nozzle (length 102). Thus the combustion chamber 82 that also entrains the powder is relatively short, and generally should be between about one and two times the diameter of open end 88.

A supply of each of the gases to the cylindrical combustion chamber is provided at a sufficiently high pressure, e.g. at least 30 psi above atmospheric, and is ignited conventionally such as with a spark device, such that the mixture of combusted gases and air will issue from the open end as a supersonic flow entraining the powder. The heat of the combustion will at least heat soften the powder material such as to deposit a coating onto a substrate. Shock diamonds should be observable. Because of the annular flow configuration, an expansion type of nozzle exit is not necessary to achieve the supersonic flow.

Figure 5:
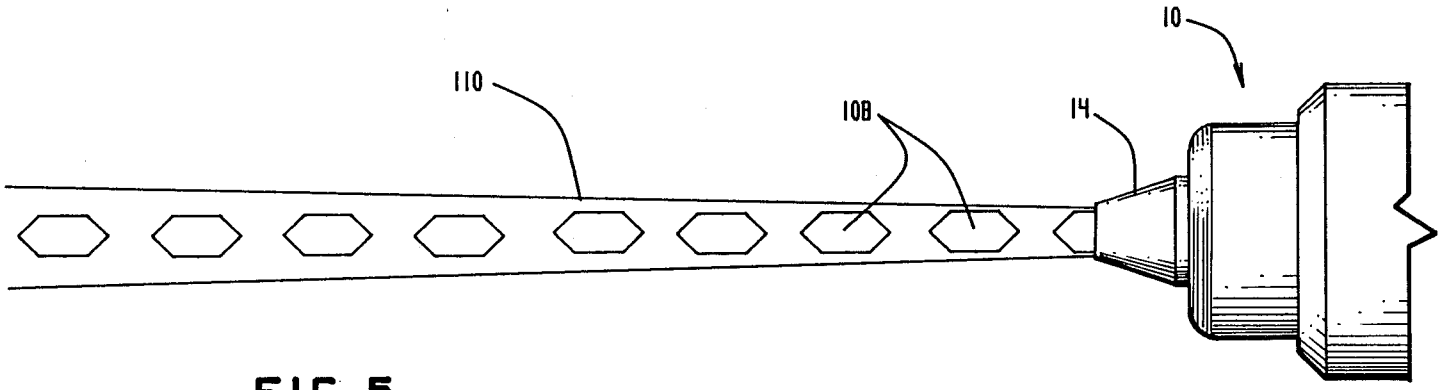
FIG. 5 is a schematic view of the gun of FIG. 1 producing a supersonic spray stream according to the present invention.
Figure 6:
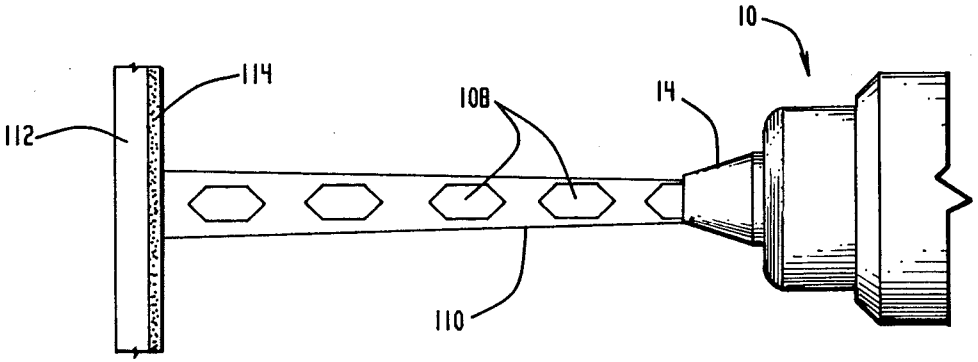
FIG. 6 is the view of FIG. 5 with a substrate in place.

According to the present invention it is highly preferable that the combustion gas be propylene gas, or methylacetylene-propadiene gas ("MPS"). It was discovered that these gases allow a relatively high velocity spray stream and excellent coatings to be achieved without backfire. For example with a propylene or MPS pressure of about 7 kg/cm$^2$ gauge (above atmospheric pressure) to the gun, oxygen at 10 kg/cm$^2$ and air at 5.6 kg/cm$^2$ at least 8 shock diamonds are readily visible in the spray stream without powder flow. The appearance of these shock diamonds 108 in spray stream 110 is illustrated in FIG. 5. The position of the substrate 112 on which a coating 114 is sprayed is preferably about where the fifth full diamond would be as shown in FIG. 6, e.g. about 9 cm spray distance.

More importantly coating quality is excellent. Especially dense and tenacious coatings of metals and metal bonded carbides are effected. For example −30 micron powders of 12% cobalt bonded tungsten carbide (Metco 71F, 73F and −30 micron 72F powders sold by The Perkin-Elmer Corporation, Westbury, N.Y.) and 25% nickel-chromium/chromium-carbide (Metco 81VF powder) have a quality (in terms of density, toughness, low solution of carbide-matrix, wear resistance) better than similar powders sprayed with a commercial rocket gun of the type described in aforementioned U.S. Pat. No. 4,416,421 using MPS gas. Coatings sprayed with the gun and the gas of the present invention approach the quality of coatings produced with such a commercial rocket gun with its optimum gas hydrogen; however hydrogen usage must be in very large quantities (685 l /min) and is correspondingly very high in cost.

Figure 7:
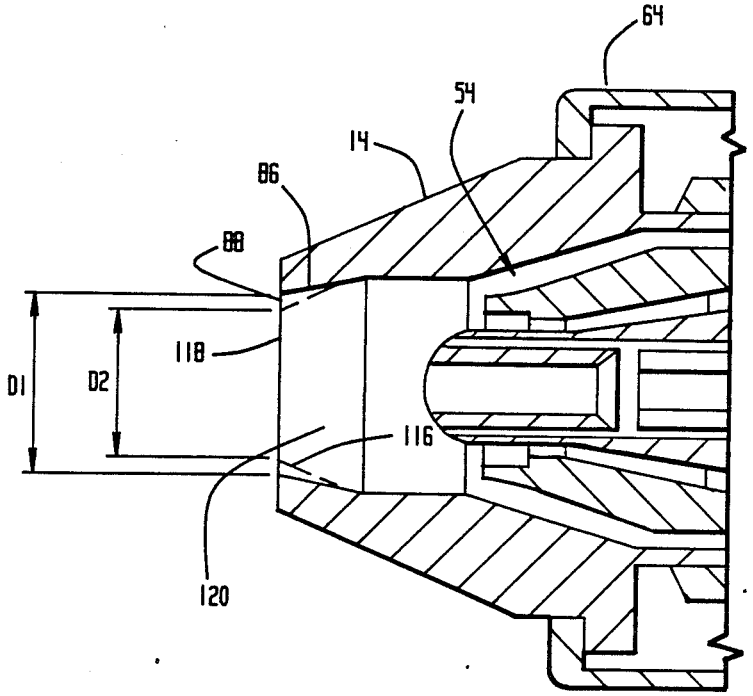
FIG. 7 is the forward portion of the section of FIG. 3 showing a further embodiment for the gas cap.

It further was discovered that the size (diameter) of the spray stream and the deposit pattern on the substrate may be selected by selection of the open end. Thus, according to a further embodiment of the present invention, other air caps of different size may be interchanged with the first air cap to control spray pattern. Referring to FIG. 7, a second air cap with a cylindrical wall 116 (designated by broken lines) with corresponding open end 118, defining an air cap size as needed, has a different open end diameter D2 than the diameter D1 for the open end 88 of the first air cap. Second cylindrical wall 116 defines a replacement combustion chamber 120.

For example, with a first air cap having an open end diameter D1 of 8 mm, a coating on a substrate at 9 cm spray distance is deposited having a diameter of 1.6 cm. A replacement air cap with an open end diameter D2 of 0.65 cm results in a coating pattern with a diameter of 0.95 cm.

Coatings produced according to the present invention are particularly useful on gas turbine engine parts where high quality coatings, such as cobalt bonded tungsten carbide and nickel-chromium bonded chromium carbide, are required. Other combinations such as iron bonded titanium carbide, as well as metals including alloys of iron, nickel, cobalt, chromium and copper are similarly excellent for producing a coating according to the present invention. Coating quality combining low oxide content, high bond strength, low density and high tenaciousness surpass state-of-the-art plasma coatings and are competitive in quality with detonation gun coatings at much lower cost. These results may be effected without the need for water cooling, and with minimized tendency for buildup. Further advantages should include easy lighting with the same gases as used in operation, and without backfire.

While the invention has been described above in detail with reference to specific embodiments, various changes and modifications which fall within the spirit of the invention and scope of the appended claims will become apparent to those skilled in this art. The invention is therefore only intended to be limited by the appended claims or their equivalents.

What is claimed is:

1. A thermal spray gun for spraying at high velocity to produce a dense and tenacious coating, comprising a nozzle member with a nozzle face, a gas cap extending from the nozzle member and having an inwardly facing cylindrical wall defining a combustion chamber with an axis, an open end and an opposite end bounded by the nozzle face, combustible gas means for injecting an annular flow of a combustible mixture of a combustion gas and oxygen from the nozzle member coaxially into the combustion chamber at a pressure therein of at least two bar above atmospheric pressure, outer gas means for injecting an annular outer flow of pressurized non-combustible gas adjacent to the cylindrical wall radially outward of the annular flow of the combustible mixture, feeding means for feeding heat fusible thermal spray powder in a carrier gas coaxially from the nozzle member into the combustion chamber proximate the axis, and inner gas means for injecting an annular inner flow of pressurized gas from the nozzle member into the combustion chamber coaxially between the combustible mixture and the powder-carrier gas, such that, with a combusting at the combustible mixture, a supersonic spray stream containing the heat fusible material in finely divided form is propelled through the open end.

2. A thermal spray gun according to claim 1 wherein the nozzle member comprises a tubular outer portion defining an outer annular orifice means for injecting the annular flow of the combustion mixture into the combustion chamber, and a tubular inner portion having therein an annular inner gas orifice means for injecting the annular inner flow into the combustion chamber and an inner powder orifice means for feeding the powder-carrier gas into the combustion chamber, and wherein the inner portion protrudes into the combustion chamber forwardly of the outer portion.

3. A thermal spray gun according to claim 2 wherein a chamber length is defined by a shortest distance from the nozzle face to the open end, and the inner portion protrudes by a distance between about 10% and 40% of the chamber length.

4. A thermal spray gun according to claim 2 wherein the outer annular orifice means includes an annular opening into the combustion chamber with a radially inward side bounded by an outer wall of the inner portion, the outer wall extending forwardly from the annular opening with a curvature toward the axis.

5. A thermal spray gun according to claim 4 wherein the curvature is such as to define a generally hemispherical nozzle face on the inner portion.

6. A thermal spray gun according to claim 2 wherein the outer gas means includes the nozzle member and a rearward portion of the cylindrical wall defining a forwardly converging slot therebetween exiting into the combustion chamber.

7. A thermal spray gun according to claim 6 wherein the combustion chamber converges forwardly at an angle with the axis less than a corresponding angle of the converging annular slot.

8. A thermal spray gun according to claim 7 wherein further comprising rate means for controlling flow rate of the outer flow of gas, and wherein a chamber length is defined by the shortest distance from the nozzle face to the open end, the converging annular slot has a slot length of at least about half of the chamber length, and the converging annular slot is disposed downstream of the rate means.

9. A thermal spray gun according to claim 2 wherein the inner powder orifice means comprises the nozzle member having an axial bore therein.

10. A thermal spray gun according to claim 1 wherein the combustible gas means is disposed so as to inject the combustible mixture into the combustion chamber from a circular location on the nozzle face, the circular location having a diameter approximately equal to the diameter of the open end.

11. A thermal spray gun according to claim 10 wherein the open end is spaced axially from the nozzle face by a shortest distance of between approximately one and two times the diameter of the circular location.

12. A thermal spray gun according to claim 1 further comprising selection means for selecting the diameter of the open end such as to effect a selected size of the spray stream.

13. A thermal spray gun according to claim 12, wherein the selection means comprises a first gas cap disposed on the gas head to form the combustion chamber with a first open end, and a second gas cap adapted to be interchanged with the first gas cap on the gas head to form a replacement combustion chamber defined by a second cylindrical wall with a second open end different in diameter than the first open end, the second gas cap being interchangeable with the first gas cap for selection between the first open end and the second open end.

14. A method for producing a dense and tenacious coating with a thermal spray gun including a nozzle member with a nozzle face, and a gas cap extending from the nozzle member and having an inwardly facing cylindrical wall defining a combustion chamber with an open end and an opposite end bounded by the nozzle face, the method comprising injecting an annular flow of a combustible mixture of a combustion gas and oxygen from the nozzle coaxially into the combustion chamber at a pressure therein of at least two bar above atmospheric pressure, injecting an annular outer flow of pressurized non-combustible gas adjacent to the cylindrical wall radially outward of the annular flow of the combustible mixture, feeding heat fusible thermal spray powder in a carrier gas axially from the nozzle into the combustion chamber, injecting an annular inner flow of pressurized gas from the nozzle member into the combustion chamber coaxially between the combustible mixture and the powder-carrier gas, combusting the combustible mixture, whereby a supersonic spray stream containing the heat fusible material in finely divided form is propelled through the open end, and directing the spray stream toward a substrate such as to produce a coating thereon.

15. A method according to claim 14 wherein the powder is a metal bonded carbide powder sized less than 30 microns.

16. A method according to claim 14 wherein the combustible mixture is injected through an annular orifice into the combustion chamber.

17. A method according to claim 14 wherein the combustible mixture is injected at a sufficient pressure into the combustion chamber to produce at least 8 visible shock diamonds in the spray stream in the absence of powder-carrier gas feeding.

18. A method according to claim 14 further comprising selecting the diameter of the open end such as to effect a selected size of the spray stream.

19. A method according to claim 14 further comprising selecting the combustion gas from the group consisting of propylene gas and methylacetylene-propadiene gas.

20. A method according to claim 14 wherein the powder is a metal powder.

21. A method according to claim 20 wherein the metal powder is selected from the group consisting of iron, nickel, cobalt, chromium and copper.

22. A method according to claim 20 wherein the metal powder is sized less than 30 microns.

* * * * *